US007104089B2

(12) United States Patent
LaCroix

(10) Patent No.: US 7,104,089 B2
(45) Date of Patent: Sep. 12, 2006

(54) RING HAVING A SETTING OF SEMI-PRECIOUS STONES

(76) Inventor: Pascal LaCroix, P.O. Box 1096, Nevada City, CA (US) 95959

( * ) Notice: Subject to any disclaimer, the term of this patent is extended or adjusted under 35 U.S.C. 154(b) by 63 days.

(21) Appl. No.: 10/797,327

(22) Filed: Mar. 10, 2004

(65) Prior Publication Data

US 2005/0199007 A1 Sep. 15, 2005

(51) Int. Cl.
*A44C 9/00* (2006.01)

(52) U.S. Cl. ..... 63/15.2; 63/15.1; 63/26

(58) Field of Classification Search ..... 63/15, 63/15.1–15.4, 15.7, 26, 28, 29.1, 31
See application file for complete search history.

(56) References Cited

U.S. PATENT DOCUMENTS

| | | | | |
|---|---|---|---|---|
| 787,733 | A | | 4/1905 | Dover |
| 1,146,543 | A | | 7/1915 | Abel |
| 1,654,335 | A | | 12/1927 | Lindroth |
| 2,016,492 | A | | 10/1935 | Granat |
| 3,307,374 | A | | 3/1967 | Kirshbaum |
| 3,307,375 | A | | 3/1967 | Estrin et al. |
| 4,493,196 | A | | 1/1985 | Bogner et al. |
| 5,161,392 | A | * | 11/1992 | Wiriath et al. ..... 63/15.7 |
| 5,228,316 | A | * | 7/1993 | Meyrowitz ..... 63/15.4 |
| 5,419,158 | A | | 5/1995 | Sandberg et al. |
| 5,806,344 | A | | 9/1998 | Bonchek |
| 5,865,042 | A | | 2/1999 | Cerqua |
| 6,062,045 | A | | 5/2000 | West |
| 6,546,749 | B1 | | 4/2003 | Canty |

OTHER PUBLICATIONS

Natural Stone Jewelry and Gifts by KVK Designs webpage http://www.kvkdesigns.com/item.html?UCIDs=354564%7C1113403&PRID=1139841.*

* cited by examiner

*Primary Examiner*—Jack W. Lavinder
(74) *Attorney, Agent, or Firm*—Stephen E. Feldman

(57) ABSTRACT

The present invention discloses a ring comprising a plurality first and second annular semi-precious stones, where the stones form a setting for a center precious stone.

20 Claims, 5 Drawing Sheets

Fig. 4
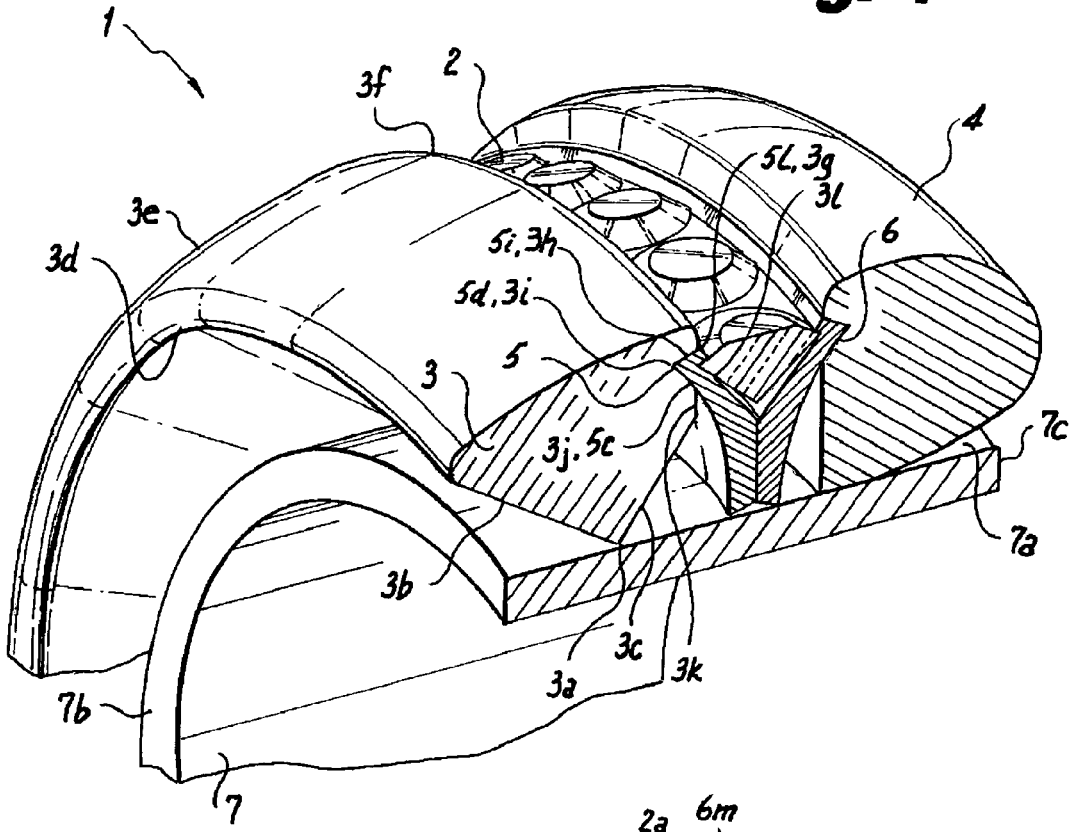
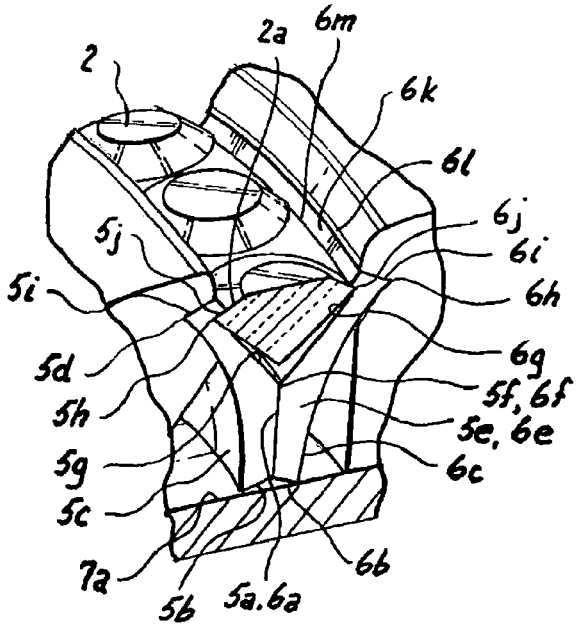
Fig. 5

Fig. 9
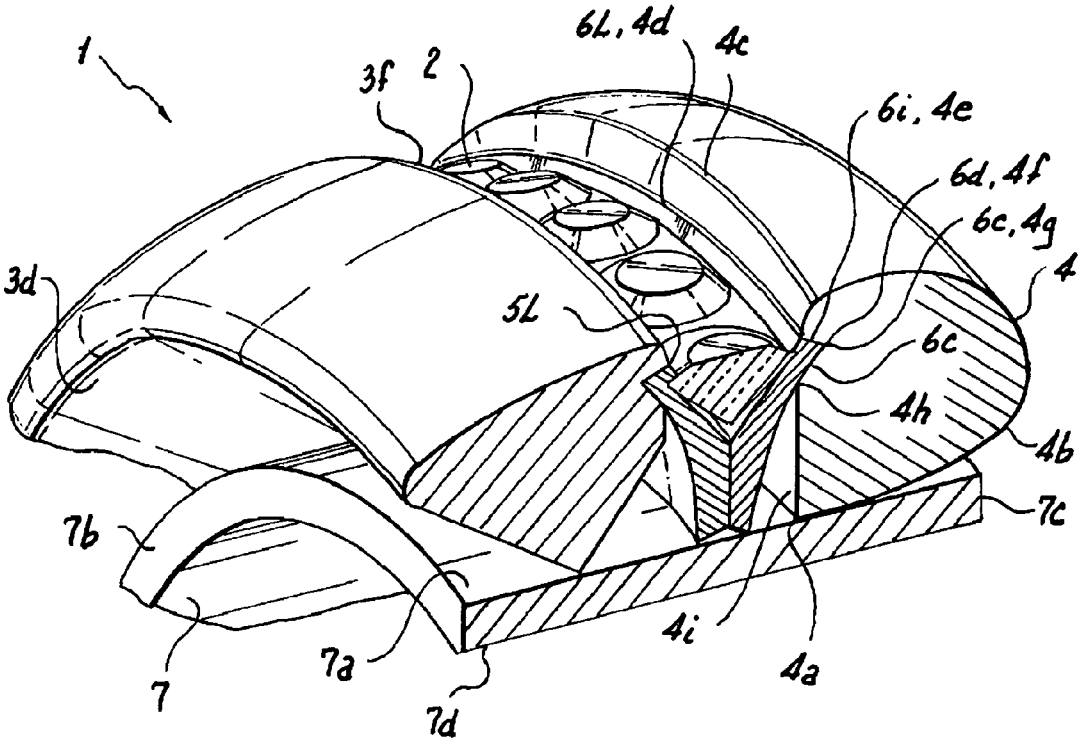
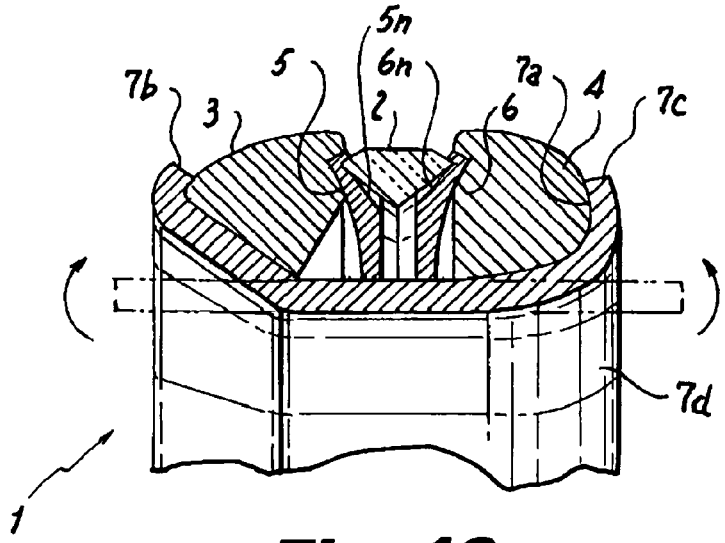
Fig. 10

RING HAVING A SETTING OF SEMI-PRECIOUS STONES

FIELD

This invention relates to a jewelry item, and more particularly to a jewelry item with a diamond setting, where the setting consists of continuous bands of semi-precious stone.

BACKGROUND

Rings are popular items of jewelry which have been worn by women and men for centuries. Generally, rings are made out of a solid metal material. The most common form of a ring constitutes a simple metallic band, often of a gold or silver alloy, fitted for the wearer's finger.

Rings containing elaborate precious or semi-precious gems are worn by people interested in donning jewelry. A diamond is one of the most popular gems and is often placed on a ring.

The beauty of diamond rings is slightly hindered by the prominent view of the metal band that supports the diamond. While every diamond is unique, metal bands, even gold bands, have a commonplace appearance. Accordingly, there is a need to provide a band for a diamond ring that has an appearance that, as compared to a metal band, enhances the uniqueness and elegance of a diamond ring.

SUMMARY

The present invention discloses a ring comprising a plurality first and second annular semi-precious stones, where the stones form a setting for center stones. The semi-precious stones are either transparent, translucent or opaque, and form a setting for precious stones.

BRIEF DESCRIPTION OF THE FIGURES

In order to satisfy the recited objective, a particular description of the invention will be rendered by reference to specific embodiments thereof that are illustrated in the appended drawings. Understanding that the drawings depict only typical embodiments of the invention and are not therefore to be considered to be limiting of its scope, the invention will be described and explained with additional specificity and detail through the use of the accompanying drawings in which:

FIG. 4 is a perspective view of the invention, taken at cross-section 3—3 in FIG. 2;

FIG. 5 is a perspective view of the invention, disclosing the support brackets and the diamonds;

FIG. 9 is another perspective view of the invention, taken at cross-section 3—3 in FIG. 2; and FIG. 10 is another perspective view of the invention, taken at cross-section 3—3 in FIG. 2, with the brace encasing the stones.

DESCRIPTION OF THE PREFERRED EMBODIMENTS

Figure 1:
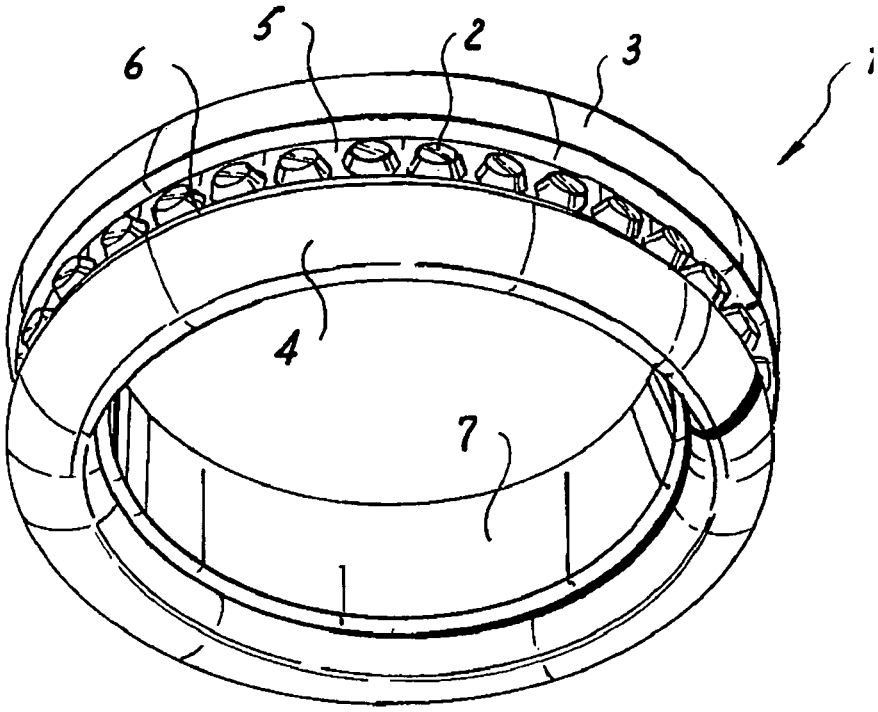
FIG. 1 is a perspective view of a ring according to the invention.
Figure 2:
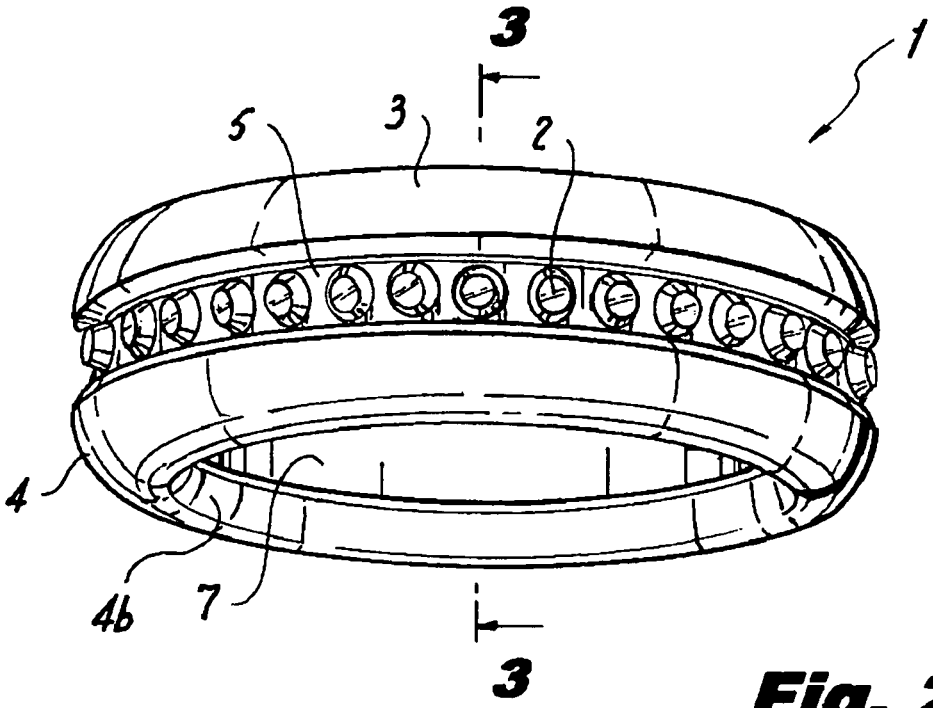
FIG. 2 is a top view of a ring according to the invention.
Figure 3:
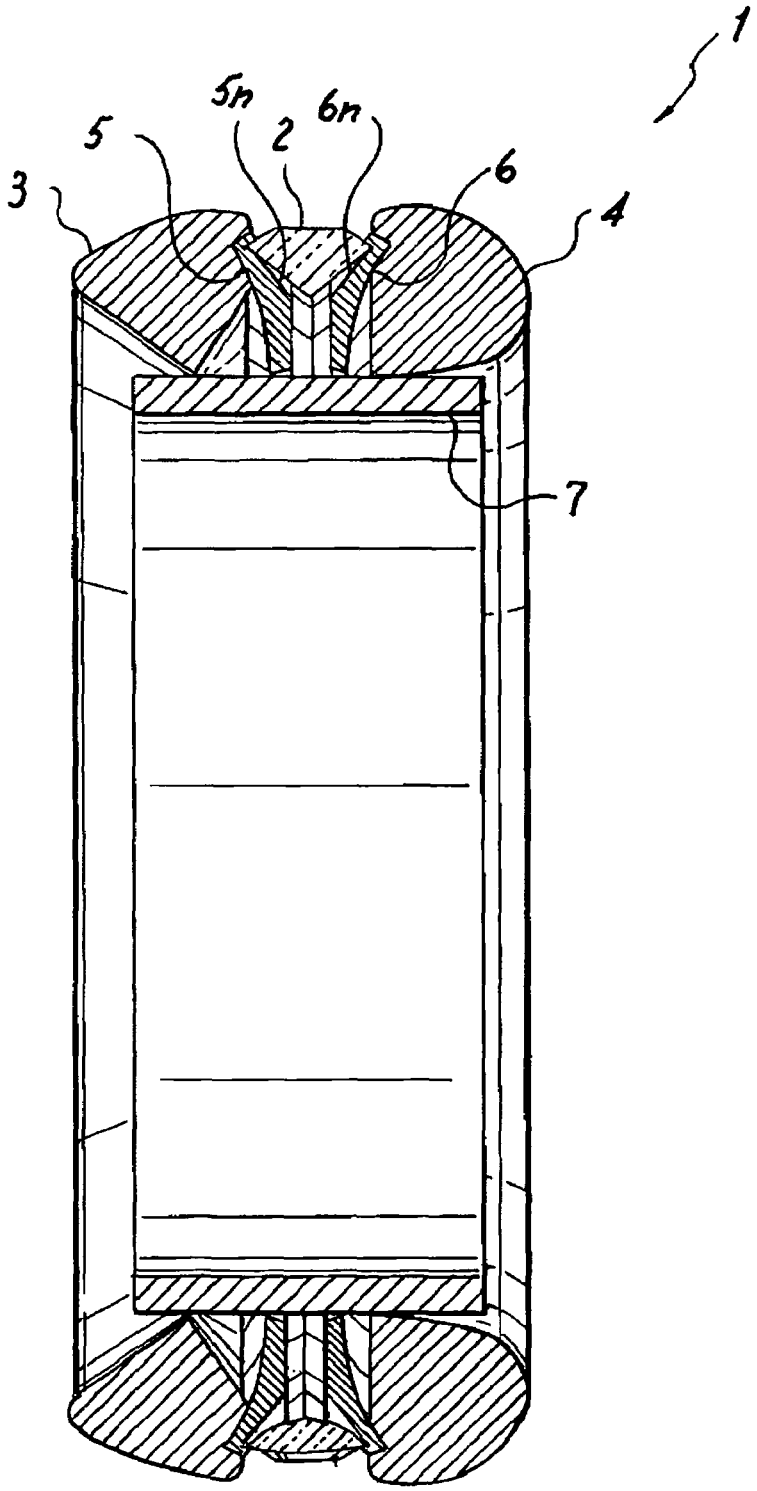
FIG. 3 is a frontal view of the invention, taken at cross-section 3—3 in FIG. 2.

Turning to FIGS. 1 and 2, a ring 1 is disclosed. The ring 1 includes first and second annular shaped semi-precious stones 3, 4 which are described below and, according to the invention, are used for setting a series of center diamonds 2. Turning to FIG. 3, the semi-precious stones 3, 4 are partially supported by members 5–7, which include brackets 5, 6 and brace 7, which will now be addressed in detail.

The brace 7, which supports the semi-precious stones 3, and 4, is a piece of metal shown in FIG. 3. Brace 7 has top surface 7*a*, bottom surface 7*d*, and side surfaces 7*b* and 7*c*. Brace has a generally cylindrical shape that is non-conical and forms the inner surface of the ring. The inner diameter of brace, surface 7*d*, is dimensioned to fit the finger of a person and may be a size or made in sizes to fit any person's finger.

Figure 6:
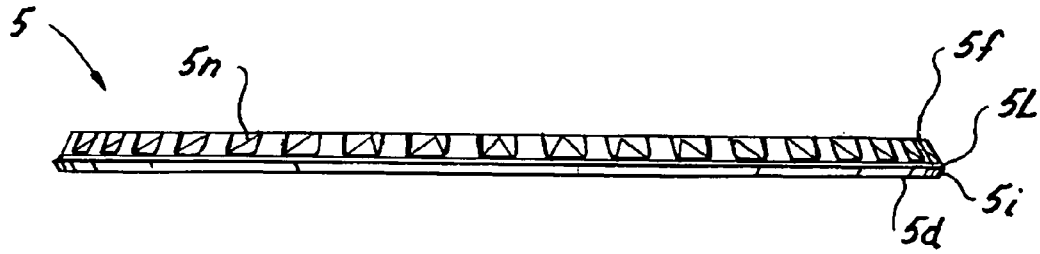
FIG. 6 is a frontal view of a center annular member according to the invention.
Figure 7:
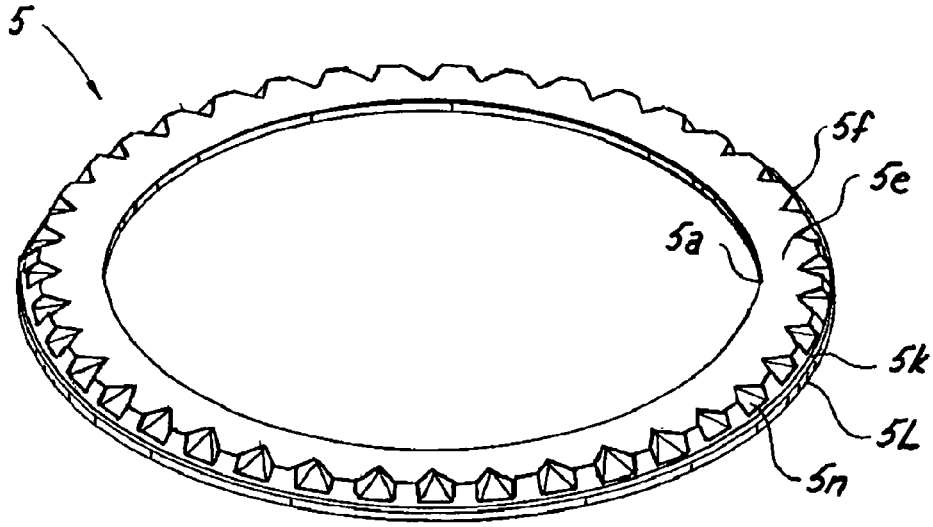
FIG. 7 is a side view of the center annular member.
Figure 8:
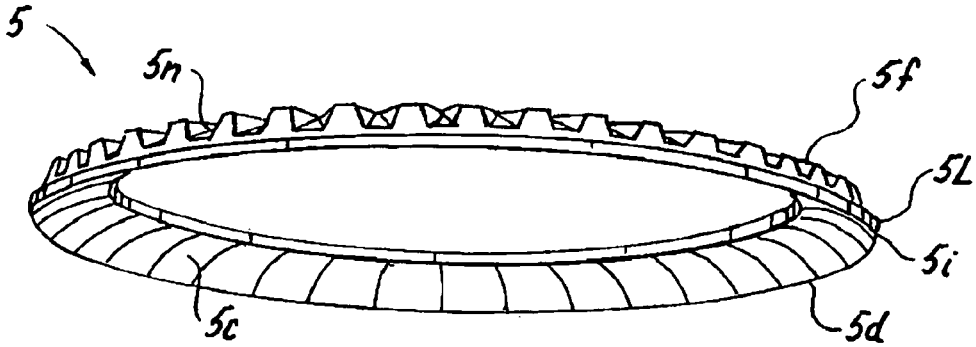
FIG. 8 is a perspective view of the center annular member.

The brackets 5 and 6, are shown in detail in FIG. 5, while bracket 5 is disclosed in further detail in FIGS. 6–8. The brackets also support the semi-precious stones 3, and 4, and are mirror images of each other.

Brackets 5, and 6 have co-linear edges 5*a*, and 6*a* which abut each other at the top surface of brace 7*a* substantially at the center of the surface 7*a*. The brackets also have surfaces 5*b*, and 6*b*, extending from edges 5*a* and 6*a*, towards opposite edges of bracket 7*b*, and 7*c*, respectively. The surfaces 5*b*, and 6*b* form a support for brackets 5, 6 on brace 7.

Extending from faces 5*b* and 6*b*, and projecting away from face 7*a*, are surfaces 5*c*, and 6*c*. Surfaces 5*c*, and 6*c* each taper outwardly, in opposed directions, towards edges 7*b* and 7*c*, respectively. Surfaces 5*c*, and 6*c* terminate at edges 5*d*, and 6*d*. The surfaces 5*c*, and 6*c* are capable of being biased inwardly by stones 3, and 4, so that brackets 5, and 6 can be biased against diamonds 2.

On the other side, projecting away from edges 5*a*, and 6*a*, and face 7*a*, are co-planar faces 5*e*, and 6*e*. Faces 5*e*, and 6*e* extend in a substantially linear direction from the center of ring 1. The faces 5*e*, and 6*e* terminate at co-linear edges 5*f*, and 6*f*, respectively. Face 5*e* supports bracket 6 and prevents bracket 6 from being displaced towards brace edge 7*b*. On the other side, face 6*e* supports bracket 5 and prevents bracket 5 from being displaced towards brace edge 7*c*.

Extending from edges 5*f*, and 6*f*, are faces 5*g*, and 6*g*, where each tapers outwardly, in opposing directions, and terminates at edges 5*h*, and 6*h*, respectively. Faces 5*g*, and 6*g*, as illustrated in FIG. 5, are capable of receiving and seating a diamond 2, from the culet to the crown.

Projecting from edges 5*d*, and 6*d* are inwardly tapered surfaces 5*i*, and 6*i*. Faces 5*i*, and 6*i* terminate at edges 5*m*, and 6*m*, respectively. Faces 5*i*, and 6*i* are capable of being biased downwardly by stones 3, and 4 so that brackets 5, and 6 are restrained against brace surface 7*a*.

On the other hand, projecting from edges 5*h*, and 6*h* are inwardly tapered surfaces 5*j*, and 6*j*. Surfaces 5*j*, and 6*j* terminate at edges 5L, and 6L. Surfaces 5*j*, and 6*j* form a lip for gripping and setting the crown of diamonds 2. Furthermore, faces 5*k* and 6*k* connect edges 5L and 5*m*, and edges 6L and 6*m*, and have a thickness that assures structural rigidity of brackets 5 and 6.

The height of brackets 5, and 6, from edge 5*a*, and 6*a*, to edge 5L, and 6L, may be about seventy five percent of the height of stones 3, and 4. The height of brackets 5, and 6 sets the table of diamonds 2 below the height of stones 3, and 4.

The width of the brackets 5, and 6, tapers from about seventy five percent of the width of each stone 3, and 4 to about twenty five percent of the width of the stones, between edges 5*d* and 6*d*, to the outside edge of surfaces 5*b*, and 6*b*. The width of brackets 5, and 6 makes the brackets capable of setting the crown of diamonds 2. The width also makes the brackets capable of abutting portions of stones 3, and 4, as described below, for setting stones 3, and 4 and brackets 5, and 6 within ring 1.

As described, brackets 5, and 6, when placed against each other, are somewhat similar to a channel setting. However, a shown in FIGS. 5–8, in the preferred embodiment, each bracket 5, 6 contains a series of baskets 5*n* and 6*n*. Baskets 5*n*, and 6*n* have a rounded contour that extends from the culet to the girdle of each diamond, but not over the crown of the diamond. Each basket 5*n*, and 6*n* engages approximately half of the surface area of the pavilion of each diamond 2.

As a result of the basket contours, the embodiment illustrated in FIG. 3 depicts a "Y" cross section that is formed around the entirety of the pavilion, girdle and crown of each diamond 2. The structure of baskets 5*n*, and 6*n* eliminates the normal voids associated with the channel setting, to provide a stronger setting, as shown in FIGS. 2 and 3.

Brackets 5, 6 are fabricated from metal, having a suitable strength, malleability and thickness for the application. The brackets are stamped or molded from metal.

Turning now to FIG. 4, the first semi-precious stone 3, used for setting diamonds 2, has an edge 3*a* that sits upon and is supported by top surface of brace 7*a*. Projecting away from brace 7*a*, are elongated linear faces 3*b*, 3*c*. Face 3*b* projects towards the edge of brace 7*b* and face 3*c* projects toward the opposing edge of brace 7*c*. The angle between faces 3*a*, and 3*c* is approximately between about 90 degrees and 120 degrees, and the angle between each face 3*c*, 3*b* and brace 7*a* is acute.

Face 3*b* of stone 3 extends past the side edge of brace 7*b* and connects with rounded edge 3*d*. Edge 3*d* connects with elongated face 3*e*, where the angle between faces 3*b*, 3*e* is acute. Face 3*e* has a curvature, the purpose of which is discussed below. Face 3*e* extends back towards edge 7*c* of brace 7, and over the top surface of bracket 5*i*. At this point, face 3*e* connects with rounded edge 3*f*, which turns to connect with bracket edge 5L at edge 3*g*. The projection of edge 3*f* over bracket surface 5*i* forms an invisible setting that helps to hide the surface 5*i* from view.

After connecting with bracket 5, stone 3 has a contour, defined by face 3*h* and edge 3*i* that is capable of receiving face 5*i* of bracket 5. The stone 3 also has face 3*j* and edge 3*k* that are capable of receiving a portion of face 5*c* of bracket 5. Faces 3*c* and 3*j* are joined by linear face 3L.

The first stone 3 is either transparent or translucent, and the illustrated angles and dimensions enhance the refraction of ambient light. The angles of the vertices provide for optimum refraction of ambient light in towards diamonds 2, providing a more brilliant illumination of diamonds 2. For example, ambient light directed toward the center of ring 1 will enter the top surface 3*e* of stone 3. Once entering the stone 3, the curvature of face 3*e* will refract the light towards face 3*c*. After reaching face 3*c*, the angle of incident will equal the angle of reflection, so that the light will reflect towards face 3*b*. Once the light has reached face 3*b*, the light will be reflected back towards face 3*e*. Upon leaving stone 3, the curvature of face 3*e* transmits the light out of the stone. With both stones 3, and 4 being transparent or translucent, and having cross sectional cuts that are mirror images of each other, the combined refraction of light will greatly illuminate on each side of each diamond.

Transparent and translucent stones are generally known in the art, having a variety of colors, reflective characteristics and surface characteristics. Examples of semi-precious stones that are transparent or translucent include amber, carnelian, amethyst, citrine, quartz, and peridot. Each known transparent and translucent stone known in the art, that is capable of being formed into an annular ring, falls within the scope of the invention.

Turning to FIG. 9, the second stone 4 which is opaque is illustrated, according to the invention. The second stone 4 has a first edge 4*a* which rests on and is supported by brace 7*a*. The stone 4 has first elongated side 4*b* that hyperbolically tapers away from the top surface of brace 7*a* towards a second edge of brace 7*c*. The side 4*b* extends past the edge of brace 7*c* by the same distance that round edge 3*d* extends past brace edge 7*b*. After the full extension, side 4*b* turns back toward the second bracket 6 to terminate at rounded edge 4*c*. Edge 4*c* extends past and over bracket edge 6L by the same distance that rounded edge 3*f* extends past and over bracket edge 5L. At this point, rounded edge 4*c* turns downward at ninety degrees to terminate on bracket edge 6L at edge 4*d*.

After intersecting bracket edge 6L, stone 4 has surfaces and edges that are capable of receiving bracket faces 6*i*, 6*c* and bracket edge 6*d*. More specifically, stone 4 has face 4*e* that terminates at edge 4*f* and is capable of abutting bracket face 6*i*. Stone 4 also has face 4*g* that terminates at edge 4*h* and is capable of abutting a portion of bracket face 6*c*. The edge of stone 4*h* intersects with linear face 4*i*, which extends toward the center of ring 1 to intersect edge 4*a* on surface 7*a* of brace 7.

The cut of stone 4 is appropriate for reflecting light from an opaque stone 4. However, it is considered that opaque stone 4 can have any cut so long as the base of stone 4 is supported by brace 7 to maintain the structural integrity of ring 1, discussed below.

Opaque stones are generally known in the art and have a variety of colors and surface characteristics. Examples of opaque semi-precious stones includes dalmation, jasper, garnet, hematite, howlite, jade, jasper, lapis, mohagany, mother of pearl, onyx, pink and red coral, poppy jasper, rhodonite, snowflake, tiger eye, tree agate and turquoise. Each known opaque stone that is capable of being formed into an annular ring falls within the scope of the invention.

Stones 3 and 4, as illustrated in FIG. 3, are different in kind. For example, stone 3 is transparent or translucent while stone 4 is opaque. This difference is for illustration purposes, and represents an embodiment of the invention. Both stones may be transparent or opaque, or one maybe opaque and the other transparent, each consisting of differing semi-precious stones.

In use, the diamonds are restrained in the following manner. As seen in FIGS. 9 and 10, the dashed and solid lines are edge 7*b*, which is flared outwardly, is bent upwardly and around stone 3 to encase surface 3*b*, edge 3*d*, and a portion of surface 3*e*. The amount of flare over surface 3*e* is only that required to securely grip stone 3 and press stone 3 towards stone 4. This bias presses the edge of stone 3*i* against the edge of bracket 5*d* and the faces of stone 3*h*, and 3*j* against bracket faces 5*i*, and 5*c*.

On the other side, the edge 7*c* of brace 7 is flared outwardly, to encase the bottom portion of hyperbolic surface 4*b* and a portion of surface 4*b* above the hyperbolic peak. The amount of flare over the hyperbolic peak on surface 4*b* is that required to securely grip stone 4 and press stone 4 towards stone 3. This bias presses the edge of stone 4*f* against bracket edge 6*d*, and the faces of stone 4*e*, and 4*g* against bracket faces 6*i*, and 6*c*.

The bias on the face of brackets 5 and 6 presses the face of bracket 5*e* against the face of bracket 6*e*, and positions bracket faces 5*g*, and 6*g*, and baskets 5*n*, and 6*n*, to create a contoured seat for each diamond 2. The biases on brackets 5 and 6 also press bracket surfaces 5*j*, and 6*j* over the crown of each diamond 2, so that each diamond 2 is set in the ring 1.

It is to be appreciated that the width of brace 7, along surfaces 7*a*, and 7*d*, is dimensioned to make brace capable of being flared over surfaces 3*e* and 4*b*. Further, the thickness of brace 7, along surfaces 7*b*, and 7*c*, is dimensioned to ensure that ring 1 is structurally secure in light of the required flaring and biasing forces needed to restrain diamonds 2.

Turning now to the series of diamonds 2, the diamonds 2 are set between stones 3, 4, as shown in FIGS. 1 and 2. Further, each diamond in the series 2 touches the girdle of the adjacent diamond and has the same cut and quality as each other diamond.

In an alternative embodiment, the size or quality of each diamond 2 can change at regular intervals, in the annular direction about ring 1. For example, at specific locations, a diamond may be mounted that is larger than the other diamonds, and larger than the viewable surface area of stones 3, 4. Yet alternatively, at specific locations, a diamond might have a different color than the other diamonds, or a blank space may be substituted at periodic locations in the annular direction. Yet alternatively, a combination of the disclosed embodiments might exist.

Accordingly, there has been provided a gemstone setting that visually consists of semi-precious stones rather than a metal band. The invention, as disclosed, enhances the uniqueness and attractiveness of a ring.

The present invention may be embodied in other specific forms without the risk of departure from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

We claim:

1. A ring comprising:

a center stone;

a first annular semi-precious stone, said first stone permitting the reflection and refraction of light; and a second annular semi-precious stone, said second stone permitting the reflection and refraction of light, whereby said first and second annular stones form a setting for the center stone and enhance the brilliance of the center stone by reflecting and refracting light towards the center stone.

2. The ring of claim 1, wherein at least one of said semi-precious stones is one of transparent and translucent.

3. The ring of claim 1, wherein said first gemstone is either transparent or translucent, and said second gemstone is opaque.

4. The ring of claim 2 where said center gemstone is a plurality of precious gemstones being set so that the pavilions of each gemstone are adjacent in an annular direction about said ring.

5. The ring of claim 4, where each of said precious gemstones is a diamond, where the girdle of each diamond touches the girdle of the adjacent diamond.

6. The ring of claim 5, where each of said semi-precious stones is toroidal in shape.

7. The ring of claim 6 having means for supporting said semi-precious stones.

8. The ring of claim 7, comprising a first bracket, a second bracket, and an axial brace; where a. said diamonds being set between said brackets;

b. said brackets being set between said semiprecious stones, said bracket gripping a portion of the pavilion, girdle, and crown of each diamond; and c. said brace being radially inside said brackets, said brace frictionally engaging said semi-precious stones toward each other and said semi-precious stones fictionally engaging said brackets for setting said diamonds.

9. The ring of claim 8, where each bracket extends radially inward and contacts said brace.

10. The ring of claim 9, where each bracket having a plurality of contoured baskets, each basket being capable of engaging substantially half of the pavilion of each diamond.

11. The ring of claim 10, where each semi-precious stone having vertices, and each bracket having corresponding vertices, and said brace biasing said stone vertices against said bracket vertices.

12. The ring of claim 11, where each of said stones is transparent or translucent, and each having a predetermined cross sectional cut for causing light to refract in a predetermined direction.

13. The ring of claim 11, where both stones are amber, carnelian, amethyst, citrine, quartz, or peridot.

14. A ring comprising:

first and second annular semi-precious stones forming a setting for a plurality of center diamonds, said first and second annular semi-precious stones being translucent; and a first bracket, a second bracket, and an annular brace, where:

a. said diamonds being set between said brackets;

b. said brackets being set between said semi-precious stones, said bracket gripping a portion of a pavilion, a girdle, and a crown of each diamond;

c. said brace being radially inside said brackets, said brace frictionally engaging said semi-precious stones thereby biasing the semi-precious stones toward each other and against said brackets for setting said diamonds.

15. A ring comprising:

a plurality of center stones;

a first annular semi-precious stone;

a second annular semi-precious stone;

a first bracket;

a second bracket, said first and second brackets being set between said first and second semi-precious stones, said first and second brackets gripping a portion of each center stone allowing said center stones to be set between said first and second brackets; and a cylindrical brace, said brace having an outer surface, said outer surface of said brace frictionally engaging said semi-precious stones, whereby the first stone, the second stone, the first bracket, the second bracket and the brace form a setting for the plurality of center stones.

16. The ring of claim 15, wherein the first semi-precious stone is one of transparent, translucent and opaque, and the second stone is one of transparent, translucent and opaque.

17. The ring of claim 15 whereby at least one of the semi-precious stones enhance the brilliance of the center stone by reflecting and refracting light towards the center stone.

18. The ring of claim 15, where each stone is opaque and has the same color.

19. The ring of claim 15, where each stone is opaque and has different colors.

20. The ring of claim 15, where both stones are dalmation, jasper, garnet, hematite, howlite, jade, jasper, lapis, mohagany, mother of pearl, onyx, pink and red coral, poppy jasper, rhodonite, snowflake, tiger eye, tree agate or turquoise.

* * * * *